US009509055B2

(12) United States Patent
Guan

(10) Patent No.: US 9,509,055 B2
(45) Date of Patent: Nov. 29, 2016

(54) ANTENNA

(71) Applicant: FUJIKURA LTD., Tokyo (JP)

(72) Inventor: Ning Guan, Sakura (JP)

(73) Assignee: FUJIKURA LTD., Tokyo (JP)

( * ) Notice: Subject to any disclaimer, the term of this patent is extended or adjusted under 35 U.S.C. 154(b) by 217 days.

(21) Appl. No.: 14/158,085

(22) Filed: Jan. 17, 2014

(65) Prior Publication Data

US 2014/0132474 A1 May 15, 2014

Related U.S. Application Data

(63) Continuation of application No. PCT/JP2012/071353, filed on Aug. 23, 2012.

(30) Foreign Application Priority Data

Sep. 9, 2011 (JP) ..... 2011-197594

(51) Int. Cl.
*H01Q 9/40* (2006.01)
*H01Q 5/50* (2015.01)
*H01P 1/203* (2006.01)

(52) U.S. Cl.
CPC ..... *H01Q 9/40* (2013.01); *H01P 1/2039* (2013.01); *H01P 1/20381* (2013.01); *H01Q 5/50* (2015.01)

(58) Field of Classification Search
None
See application file for complete search history.

(56) References Cited

U.S. PATENT DOCUMENTS

| | | | | |
|---|---|---|---|---|
| 5,977,847 | A | 11/1999 | Takahashi | |
| 2007/0262902 | A1* | 11/2007 | Iwata | H01Q 9/40 343/700 MS |
| 2010/0182210 | A1 | 7/2010 | Ryou et al. | |
| 2012/0112966 | A1 | 5/2012 | Tayama et al. | |
| 2012/0169436 | A1* | 7/2012 | Nusair | H01P 1/2039 333/204 |

FOREIGN PATENT DOCUMENTS

| | | | |
|---|---|---|---|
| JP | 10-215102 | A | 8/1998 |
| JP | 2006-166041 | A | 6/2006 |
| JP | 2007-306232 | A | 11/2007 |
| JP | 2008-535372 | A | 8/2008 |
| JP | 2010-050653 | A | 3/2010 |
| WO | 2010/113336 | A1 | 10/2010 |

OTHER PUBLICATIONS

International Search Report dated Nov. 20, 2012, issued in corresponding application No. PCT/JP2012/071353.
Notification of Transmittal of Translation of the International Preliminary Report on Patentabililty (Form PCT/IB/338) of International Application No. PCT/JP2012/071353 mailed Mar. 20, 2014 with Forms PCT/IB/373 and PCT/ISA/237 (6 pages).
Japanese Decision to Grant a Patent dated Feb. 24, 2015, issued in corresponding JP Patent Application No. 2013-532536 with English translation (3 pages).
Japanese Office Action dated Nov. 11, 2014, issued in corresponding JP Patent Application No. 2013-532536 with English translation (5 pages).

* cited by examiner

*Primary Examiner* — Robert Karacsony
(74) *Attorney, Agent, or Firm* — Westerman, Hattori, Daniels & Adrian, LLP

(57) ABSTRACT

An antenna (1) including a dielectric substrate (10), an antenna element (11), a feed line (12), and a ground plate (13) is configured such that the feed line (12) and the ground plate (13) which face each other via the dielectric substrate (10) constitute a microstrip line which functions as a BRF.

10 Claims, 8 Drawing Sheets

ANTENNA

CROSS-REFERENCE TO RELATED APPLICATIONS

This application is a Continuation of PCT International Application No. PCT/JP2012/071353 filed in Japan on Aug. 23, 2012, which claims the benefit of Patent Application No. 2011-197594 filed in Japan on Sep. 9, 2011, the entire contents of which are hereby incorporated by reference.

TECHNICAL FIELD

The present invention relates particularly to an antenna which avoids interfering with a specific band.

BACKGROUND ART

In recent years, a demand for a wide band antenna has been increased as a UWB wireless and the like have been widely used. However, a UWB (of not less than 3.1 GHz and not more than 10.6 GHz) stipulated by the FCC (Federal Communications Commission) includes a 5 GHz band (of not less than 5.15 GHz and not more than 5.85 GHz) used for a wireless LAN (IEEE802.11a). Accordingly, a wide band antenna used for the UWB wireless is requested not only to have a wide band property to cover the UWB but also to avoid interfering with the 5 GHz band.

A known antenna that meets such a request is exemplified by a patch antenna described in Patent Literature 1. The patch antenna described in Patent Literature 1 is configured to cover a wide band by providing a stub in an antenna element and providing a step in a ground plate. Furthermore, the patch antenna is configured to avoid interfering with a wireless LAN by providing a slit in the antenna element.

Furthermore, a known BRF (band reject filter) for a wireless station of a UWB system is exemplified by a BRF described in Patent Literature 2. The BRF described in Patent Literature 2 is configured such that a microstrip line has a nonuniform width so as to enhance a reflection coefficient in a specific band (a band in which interference should be avoided).

CITATION LIST

Patent Literature

Patent Literature 1

Japanese Translation of PCT International Application, Tokuhyo, No. 2008-535372 A (Publication Date: Aug. 28, 2008)

Patent Literature 2

Japanese Patent Application Publication, Tokukai, No. 2010-50653 A (Publication Date: Mar. 4, 2010)

SUMMARY OF INVENTION

Technical Problem

According to the patch antenna described in Patent Literature 1, it is necessary to design a slit suitable for a band in which interference should be avoided. However, the patch antenna described in Patent Literature 1 has a problem of difficulty in designing such a slit. Specifically, the patch antenna described in Patent Literature 1 has the following problem: although there is a principle that it is only necessary to provide a slit having a length approximately half of a wavelength suitable for the band in which interference should be avoided, a bending of the slit makes it impossible to obtain a desired reflection coefficient and consequently makes it necessary to repeatedly produce a slit on a trial basis so as to obtain a desired reflection coefficient. Meanwhile, the patch antenna described in Patent Literature 1 also has the following problem: an attempt to provide a linear slit having a length approximately half of the wavelength suitable for the band in which interference should be avoided makes an antenna element larger.

Meanwhile, the BRF described in Patent Literature 2 has a preferable property such that even a bending of a microstrip line makes it possible to obtain a desired reflection coefficient. However, the BRF described in Patent Literature 2 is used by being attached to an antenna. This causes a problem such that use of the BRF described in Patent Literature 2 requires not only a mounting surface on which the antenna is mounted, but also a mounting surface on which the BRF is mounted. Although a mounting area may be reduced by integrating the BRF with the antenna, no specific method has been known for integrating the BRF with the antenna.

The present invention has been made in view of the above problems, and an object of the present invention is to provide an antenna (i) which, while having a wide operation band, avoids interfering with a part of the wide operation band and (ii) which requires a smaller mounting area than a conventional antenna.

Solution to Problem

In order to attain the object, an antenna in accordance with the present invention includes: a dielectric substrate; a ground plate provided on a first main surface of the dielectric substrate; a feed line provided on a second main surface of the dielectric substrate; and an antenna element connected to the feed line and standing on the first main surface or the second main surface of the dielectric substrate, the feed line being a belt-shaped conductor which has a nonuniform width, and together with the ground plate which faces the feed line via the dielectric substrate, the feed line constituting a microstrip line which functions as a BRF (band reject filter).

According to the configuration, since the feed line and the ground plate constitute a microstrip line which functions as the BRF, it is possible to provide an antenna which, while being operable in a wide operation band, avoids interfering with a part of the wide operation band. In this case, the microstrip line is constituted by the feed line and the ground plate. This requires no mounting area for providing a BRF separately from the microstrip line. Therefore, the antenna requires a smaller mounting area than a conventional antenna.

Advantageous Effects of Invention

According to the present invention, it is possible to provide an antenna (i) which, while having a wide operation band, avoids interfering with a part of the wide operation band and (ii) which requires a smaller mounting area than a conventional antenna.

Figure 1:
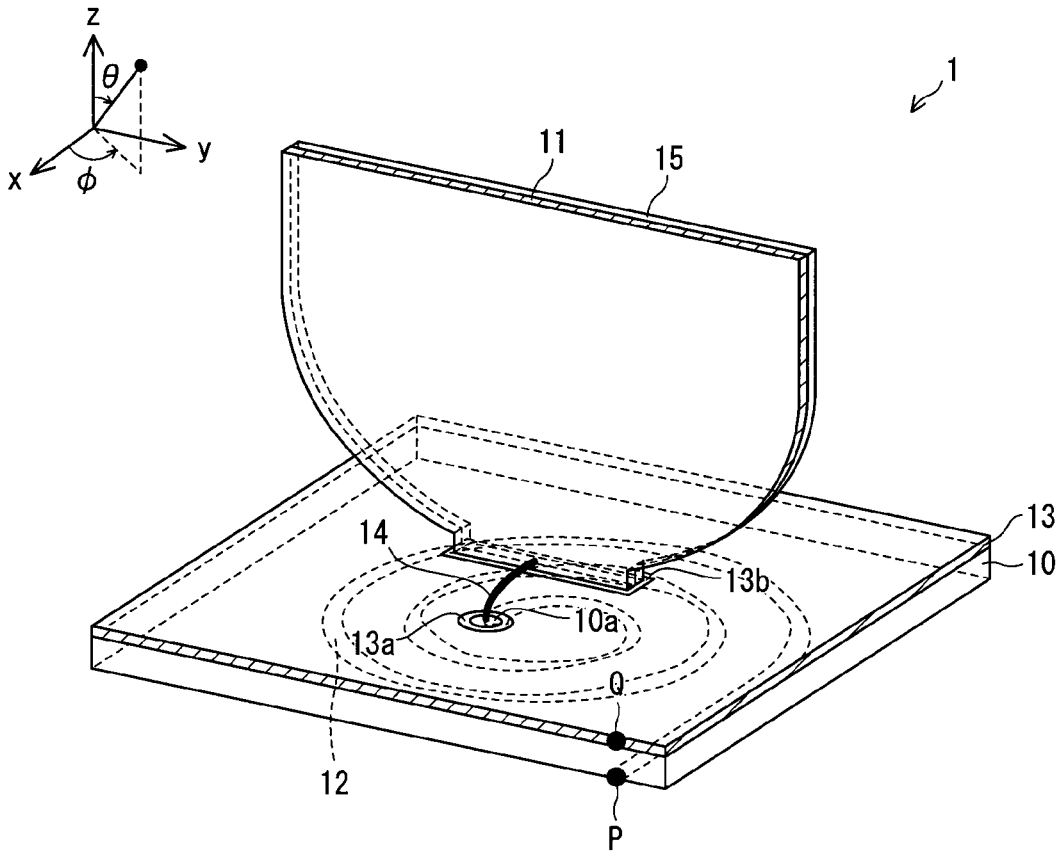
FIG. 1 is a perspective view of an antenna in accordance with an embodiment of the present invention.
Figure 2:
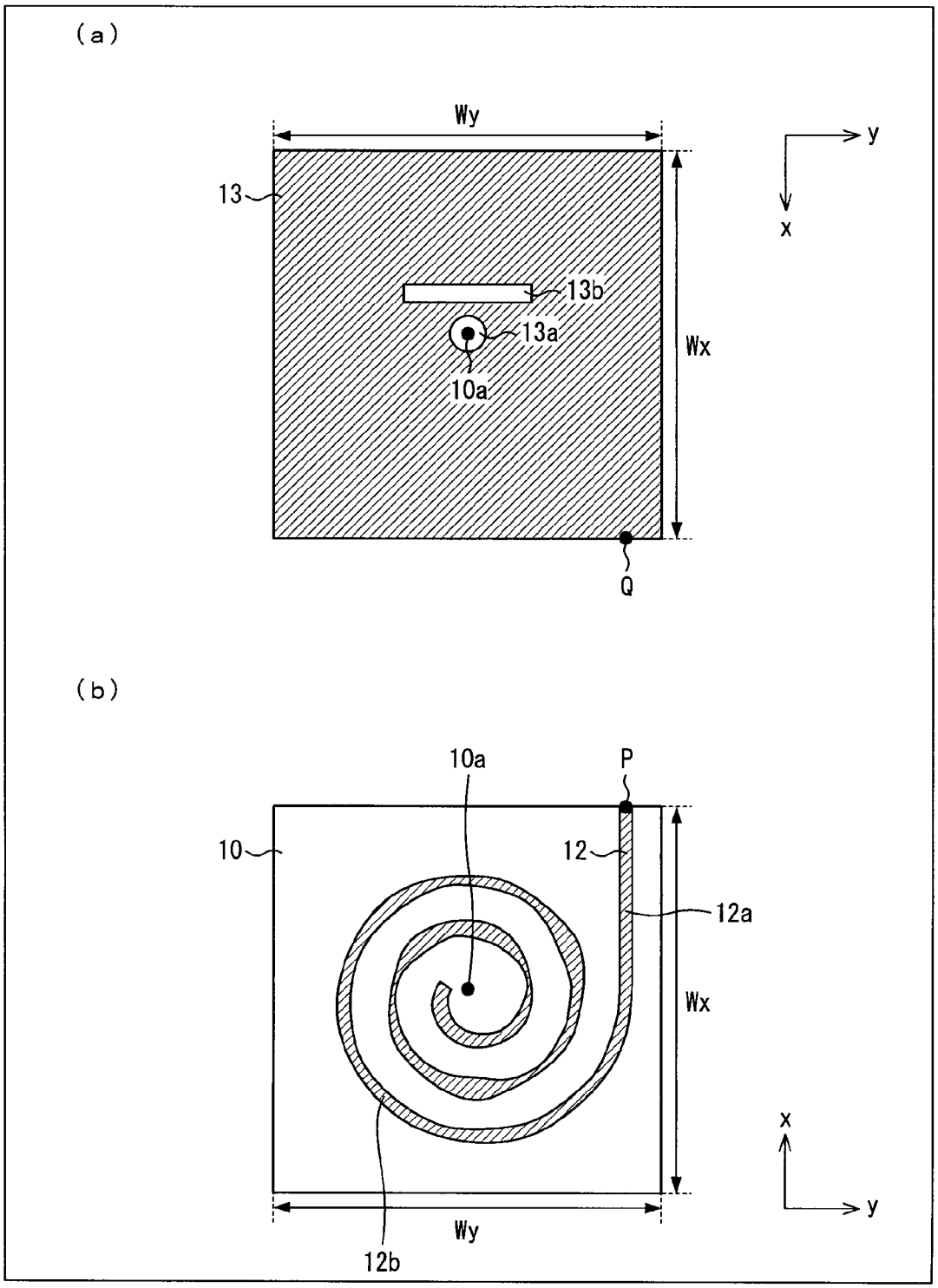

(a) of FIG. 2 is a plan view illustrating a dielectric substrate included in the antenna illustrated in FIG. 1, especially a top surface of the dielectric substrate on which top surface a ground plate is provided. (b) of FIG. 2 is a plan view illustrating the dielectric substrate included in the antenna illustrated in FIG. 1, especially a bottom surface of the dielectric substrate on which bottom surface a feed line is provided.

Figure 3:
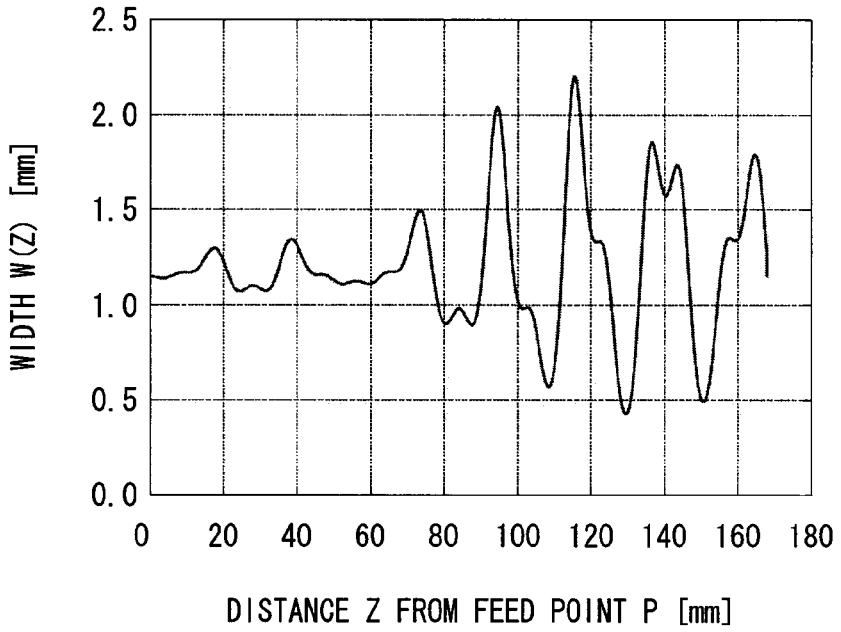

FIG. 3 is a graph showing a width W(z) of the feed line included in the antenna illustrated in FIG. 1. Note that W(z) indicates the width of the feed line at a point P(z) on the feed line which point P(z) has a distance z [mm] from a feed point which distance z is measured along the feed line.

Figure 4:
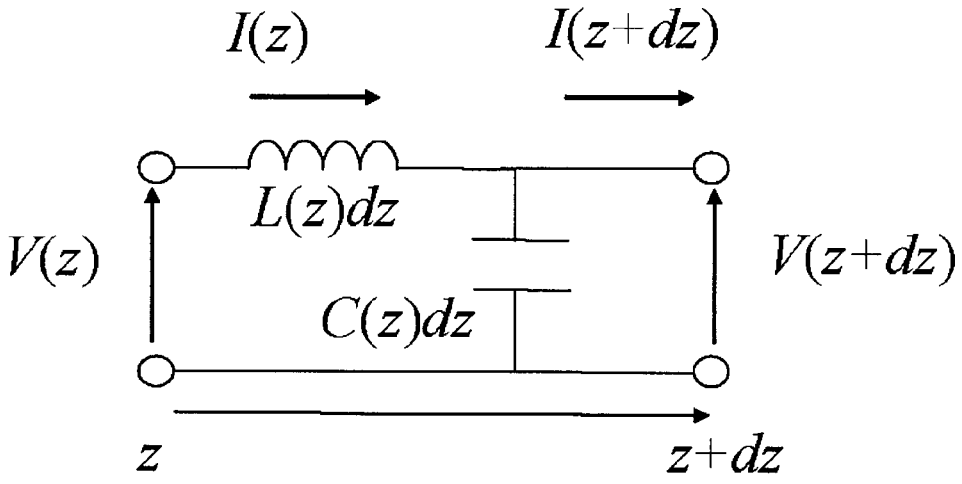

FIG. 4 is a circuit diagram of an equivalent circuit which is equivalent to a microstrip line constituted by the feed line and the ground plate each included in the antenna illustrated in FIG. 1.

Figure 5:
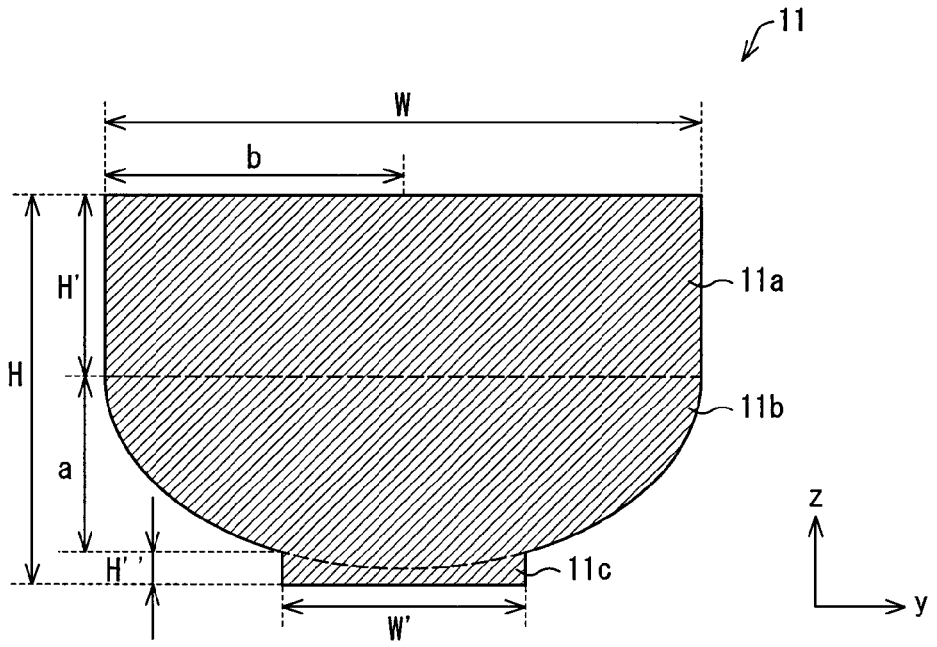

FIG. 5 is a plan view of an antenna element which is included in the antenna illustrated in FIG. 1 and is seen from the front.

Figure 6:
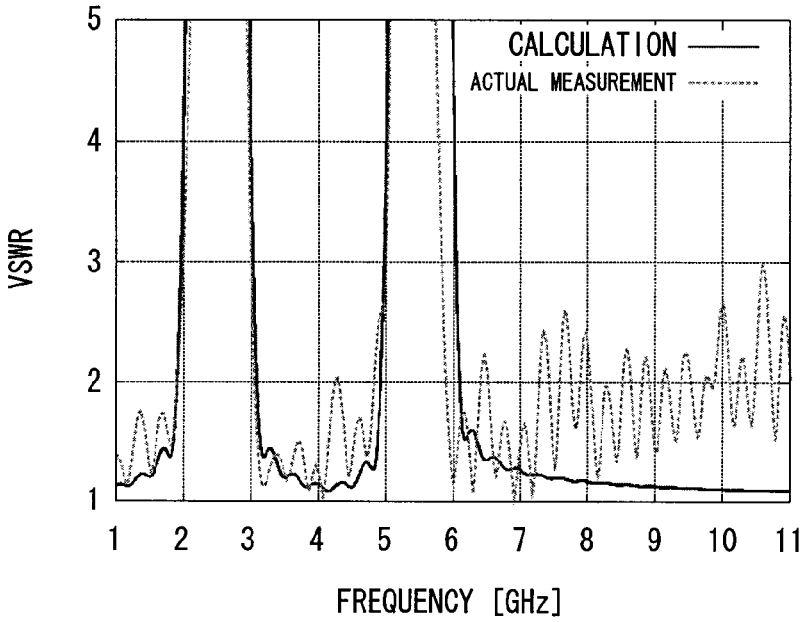

FIG. 6 is a graph showing VSWR characteristics of the antenna illustrated in FIG. 1, the VSWR characteristics being obtained when the antenna element is removed.

Figure 7:
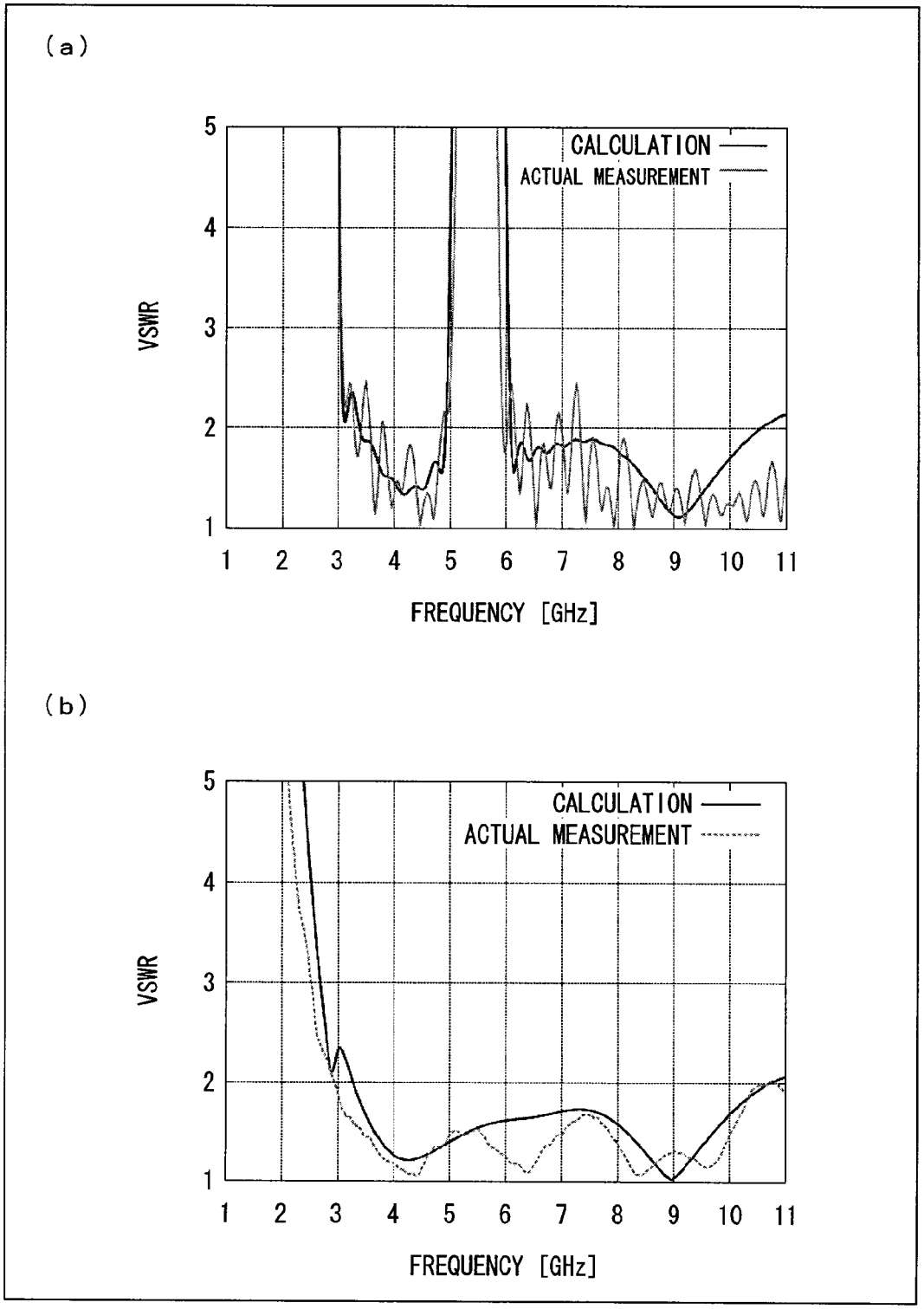

(a) of FIG. 7 is a graph showing VSWR characteristics of the antenna illustrated in FIG. 1. (b) of FIG. 7 is a graph showing VSWR characteristics of the antenna illustrated in FIG. 1, the VSWR characteristics being obtained when the width of the feed line is made uniform.

Figure 8:
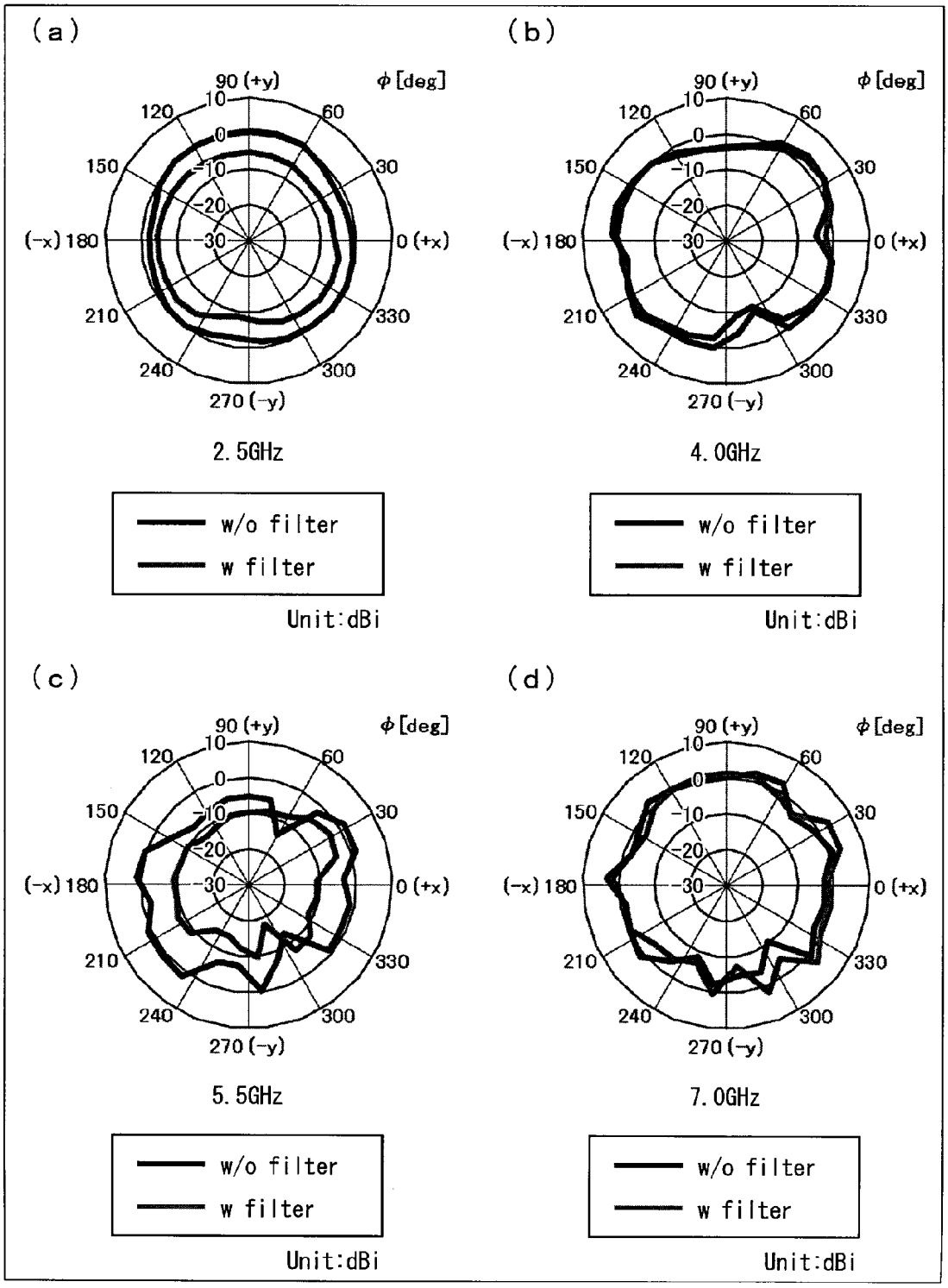

FIG. 8 are graphs each showing a radiation pattern of the antenna illustrated in FIG. 1. (a) of FIG. 8 shows a radiation pattern obtained at 2.5 GHz, (b) of FIG. 8 shows a radiation pattern obtained at 4.0 GHz, (c) of FIG. 8 shows a radiation pattern obtained at 5.5 GHz, and (d) of FIG. 8 shows a radiation pattern obtained at 7.0 GHz. In each of the graphs, w/o filter corresponds to a case where the width of the feed line is made uniform and w filter corresponds to a case where the width of the feed line is made nonuniform as illustrated in FIG. 3.

Figure 9:
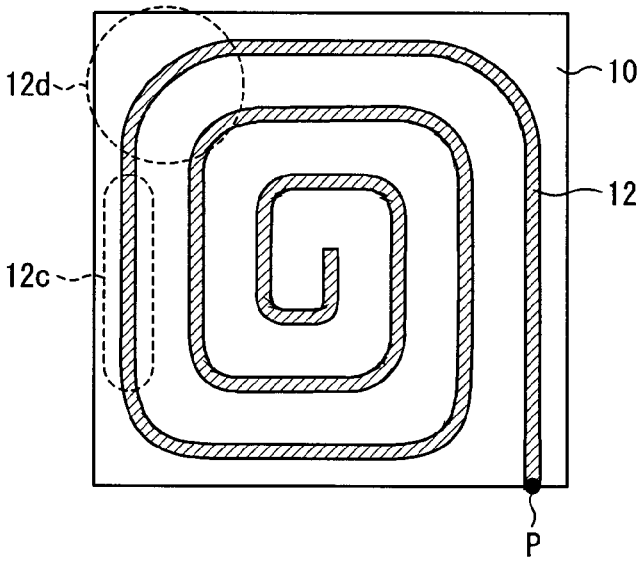

FIG. 9 is a plan view illustrating a modification of the feed line included in the antenna illustrated in FIG. 1.

Figure 10:
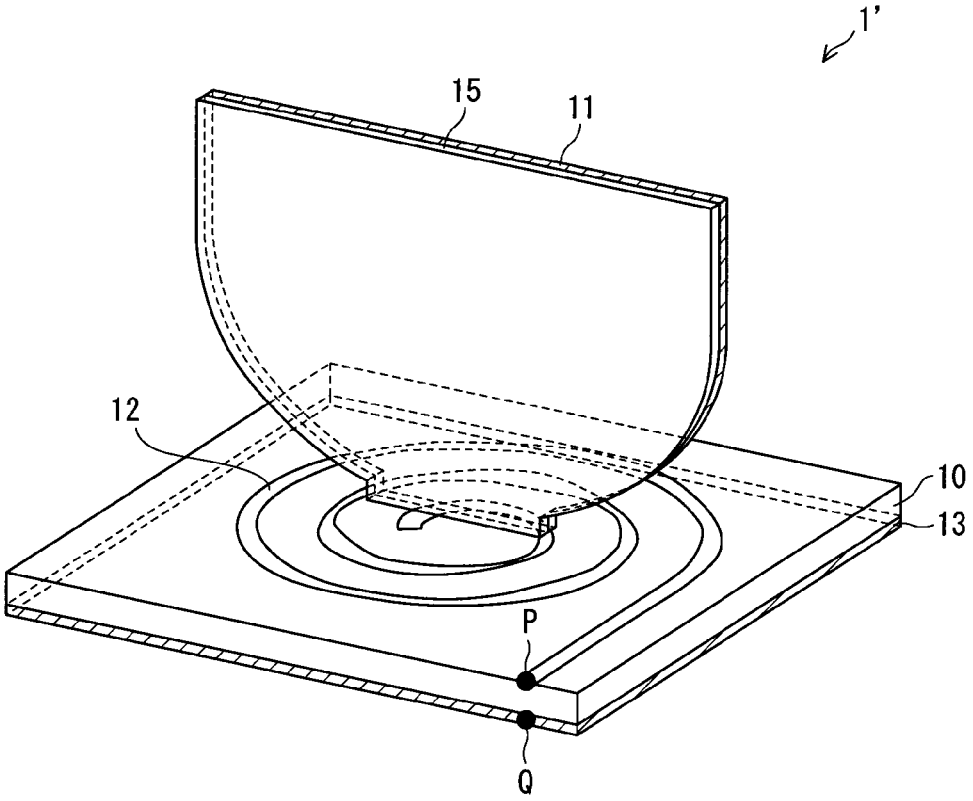

FIG. 10 is a perspective view illustrating a modification of the antenna illustrated in FIG. 1.

DESCRIPTION OF EMBODIMENTS

An antenna in accordance with the present embodiment is described below with reference to the drawings.

Note that an operation band of the antenna in accordance with the present embodiment is a band obtained by excluding a 5 GHz band (of not less than 5.15 GHz and not more than 5.85 GHz) from a UWB (of not less than 3.1 GHz and not more than 10.6 GHz). Note, however, that the present invention is applicable to a general antenna which operates in a band obtained by excluding a specific part from a specific band, and a combination of the specific band and the specific part is not limited to the above combination of the UWB and the 5 GHz band.

The following description refers to two largest-area surfaces of six surfaces constituting a plate-like member as "main surfaces", and refers to the remaining four surfaces other than the two main surfaces as "end surfaces". In a case where the two main surfaces need to be distinguished from each other, the following description refers to one of the main surfaces as a "top surface", and refers to the other of the main surfaces as a "bottom surface". Note that the "top surface" and the "bottom surface", which are terms for distinguishing the two main surfaces from each other, do not limit how to provide the plate-like member.

[Structure of Antenna]

A structure of an antenna 1 in accordance with the present embodiment is described below with reference to FIG. 1. FIG. 1 is a perspective view of the antenna 1.

The antenna 1 includes (i) an antenna element 11 standing on a first main surface (hereinafter referred to as a "top surface") of a dielectric substrate 10, (ii) a feed line provided on a second main surface (hereinafter described as a "bottom surface") of the dielectric substrate 10 and connected to the antenna element 11, and (iii) a ground plate 13 provided on the top surface of the dielectric substrate 10 (see FIG. 1). The antenna element 11 and the feed line 12 are connected to each other via a conductor wire 14 which extends through a through hole 10*a* provided in the dielectric substrate 10. Note that there is no electrical connection between the antenna element 11 and the ground plate 13 and between the conductor wire 14 and the ground plate 13.

The antenna 1, which receives supply of a high frequency electric current from a pair of feed points P and Q, functions as a monopole antenna. Note that the feed point P to which an inner conductor of a coaxial cable (not shown) is connected is provided at an end point of the feed line 12 (i.e., an end point on a side opposite from the antenna element 11) (see FIG. 1). Meanwhile, the feed point Q to which an outer conductor of the coaxial cable (not shown) is connected is provided at a point which is the closest to the feed point P of points on an end side of the ground plate 13 (see FIG. 1).

The antenna 1 employs a configuration such that, in order to cause the UWB to be the operation band, the antenna 1 uses a bell-shaped planar conductor as the antenna element 11 and causes a dielectric substrate 15 to support the antenna element 11. Note that an embodiment which is illustrated in FIG. 1 and in which the antenna element 11 stands upright does not exclude an embodiment in which the antenna element 11 is inclined. The antenna element 11 will be specifically discussed later with reference to another drawing instead of FIG. 1.

Furthermore, according to the antenna 1, the feed line 12 has a nonuniform width so that a 2.5 GHz band and the 5 GHz band are excluded from the operation band. This allows a microstrip line constituted by the feed line 12 and the ground plate 13 of the antenna 1 to function as a BRF (band reject filter). Employment of such a configuration makes it unnecessary to provide a BRF separately from the microstrip line. The feed line 12 and the ground plate 13 will be specifically discussed later with reference to another drawing instead of FIG. 1.

Note that the following description assumes a surface on which the ground plate 13 is provided to be an xy plane, and assumes an axis perpendicular to the xy plane to be a z axis. The following description also assumes (i) that an x axis extends in a direction perpendicular to a surface on which the antenna element 11 is provided and that (ii) a y axis extends in a direction perpendicular to each of the x axis and the z axis.

[Detailed Description of Feed Line and Ground Plate]

Next, the ground plate 13 is specifically described below with reference to (a) of FIG. 2. (a) of FIG. 2 is a plan view illustrating the top surface of the dielectric substrate 10 on which top surface the ground plate 13 is provided.

The present embodiment uses, as the ground plate 13, a rectangular planar conductor which covers the top surface of the dielectric substrate 10 (see (a) of FIG. 2). Note, however, that an opening 13*a* which is circular and an opening 13*b* which is rectangular are provided near a center of the ground plate 13 (see (a) of FIG. 2) and that the top surface of the dielectric substrate 10 is exposed in the openings 13*a* and 13*b*.

The through hole 10*a* is provided in a circular region of the dielectric substrate 10 which circular region is exposed by the opening 13*a* (see (a) of FIG. 2). This prevents the conductor wire 14 which extends through the through hole 10*a* from contacting the ground plate 13. This is why there is no electrical connection between the conductor wire 14 and the ground plate 13. Meanwhile, the antenna element 11 is connected to a rectangular region of the dielectric substance 10 which rectangular region is exposed by the opening 13*b* (see FIG. 1). This prevents the antenna element 11 from contacting the ground plate 13. This is why there is no electrical connection between the antenna element 11 and the ground plate 13.

Note that the present embodiment uses, as the dielectric substance 10, a dielectric substrate which has a length Wx of 40 mm, a width Wy of 40 mm, a thickness of 1.27 mm, and a relative dielectric constant of 10.6. Furthermore, the present embodiment uses, as the ground plate 13, a copper foil which has a length Wx of 40 mm and a width Wy of 40 mm.

Next, the feed line 12 is specifically described below with reference to (b) of FIG. 2. (b) of FIG. 2 is a plan view illustrating the bottom surface of the dielectric substance 10 on which bottom surface the feed line 12 is provided.

The present embodiment uses, as the feed line 12, a belt-shaped conductor (more specifically, a copper foil) which has a nonuniform width (see (b) of FIG. 2). In particular, the present embodiment uses, as the feed line 12, a belt-shaped conductor having a linear part 12*a* and a spiral part 12*b* (see (b) of FIG. 2). The linear part 12*a* of the feed line 12 is a part which extends straight in an x axis direction from the feed point P and has a length of Wx/2. The spiral part 12*b* is a part obtained by excluding the linear part 12*a* from the feed line 12 and makes a two and a half revolution around the through hole 10*a* while gradually reducing a distance from the through hole 10*a*. In a case where the feed line 12 having the configuration is used, even if the feed line 12 has a long length and is to be contained in a narrow region, it is possible to prevent parts of the feed line 12 from being combined together, while maintaining a space between the parts.

Note that the present embodiment uses, as the feed line 12, a belt-shaped copper foil which has a length of 170 mm and an average width of 1.2 mm. Note also that the present embodiment determines shapes of the linear part 12*a* and the spiral part 12*b* so that the parts of the feed line 12 are spaced 5 mm or more apart.

In order that reflection occurs in the 2.5 GHz band and the 5 GHz band, a width W(z) of each part of the feed line 12 is set in accordance with a graph shown in FIG. 3. Note here that W(z) indicates the width of the feed line 12 at a point P(z) on the feed line 12 which point P(z) has a distance z [mm] from the feed point P which distance z is measured along the feed line 12.

[Method for Determining Feed Line Width]

The width W(z) of the each part of the feed line 12 shown in FIG. 3 can be determined by the following two steps:

Step 1: determining a value of an impedance Z(z) at each point P(z) on the feed line 12 so that reflection occurs in the 2.5 GHz band and the 5 GHz band.

Step 2: determining the width W(z) of the each part of the feed line 12 so that the impedance Z(z) at the each point P(z) on the feed line 12 has a value determined in the step 1.

The value of the impedance Z(z) is determined in the step 1 based on a telegraphic equation. The following description discusses, with reference to FIG. 4, how to determine the width Z(z) of the each part of the feed line 12 based on the telegraphic equation.

FIG. 4 is a circuit diagram of an equivalent circuit which is equivalent to the microstrip line constituted by the feed line 12 and the ground plate 13. In FIG. 4, L(z) indicates an inductance per unit length at the point P(z), and C(z) indicates a capacitance per unit length at the point P(z).

Respective telegraphic equations for a voltage V and an electric current I each having a time term exp (−jωt) are given by the following equations (1) and (2):

[Math. 1]

$$\frac{dV(z)}{dz} = j\omega L(z)I(z) \tag{1}$$

[Math. 2]

$$\frac{dI(z)}{dt} = j\omega C(z)V(z) \tag{2}$$

The following Zakharov-Shabat equations (3) and (4) are derived from the telegraphic equations (1) and (2).

[Math. 3]

$$\frac{\partial v_1(x,\omega)}{\partial x} + j\omega v_1(x,\omega) = -q(x)v_2(x,\omega) \tag{3}$$

[Math. 4]

$$\frac{\partial v_2(x,\omega)}{\partial x} - j\omega v_2(x,\omega) = q(x)v_1(x,\omega) \tag{4}$$

The following variable transformations (5) and (6) are used to derive the Zakharov-Shabat equations (3) and (4).

[Math. 5]

$$v_1(x,\omega) = \frac{V(x,\omega) + Z(x)I(x,\omega)}{2\sqrt{Z(x)}},\ v_2(x,\omega) = \frac{V(x,\omega) - Z(x)I(x,\omega)}{2\sqrt{Z(x)}} \tag{5}$$

[Math. 6]

$$x(z) = \int_0^z \sqrt{L(s)C(s)}\,ds,\ Z(z) = \sqrt{\frac{L(z)}{C(z)}},\ q(x) = \frac{1}{2}\frac{d\ln Z(x)}{dx} \tag{6}$$

If a reflection coefficient r(ω) is defined as the following (7), its inverse Fourier transformation R(x) is given as the following (8). Note that r(ω) has no pole in the upper half plane.

[Math. 7]

$$r(\omega) = \lim_{x\to-\infty}\left[\frac{v_1(x,\omega)}{v_2(x,\omega)}\right]e^{2j\omega x} \tag{7}$$

-continued

[Math. 8]

$$R(x) = \frac{1}{2\pi}\int_{-\infty}^{\infty} r(\omega)e^{-j\omega x}d\omega \quad (8)$$

There is a relationship expressed by the following (11) between a solution q(x) of the Zakharov-Shabat equations (3) and (4) and a solution A2 (x, y) of Gel'fand-Levitan-Marchenko-type integral equations (9) and (10). Therefore, in order to obtain the solution q(x) of the Zakharov-Shabat equations (3) and (4), it is only necessary to solve the integral equations (9) and (10) so as to obtain the solution A2 (x, y), and then to calculate the q(x) from the obtained solution A2 (x, y) based on the following equation (11).

[Math. 9]

$$A_1^*(x,y)+\int_{-y}^{x}A_2(x,s)R(y+s)ds=0 \quad (9)$$

[Math. 10]

$$A_2^*(x,y)+R(x+y)+\int_{-y}^{x}A_1(x,s)R(y+s)ds=0 \quad (10)$$

[Math. 11]

$$q(x)=2A_2^*(x,x) \quad (11)$$

The impedance Z(x) can be calculated from the q(x) based on the following equation (12):

[Math. 12]

$$Z(x)=Z(0)\exp(2\int_0^x q(s)ds) \quad (12)$$

[Specific Description of Antenna Element]

Next, the antenna element 11 is specifically described below with reference to FIG. 5. FIG. 5 is a plan view of the antenna element 11 seen from the front.

The antenna element 11 has a first rectangular part 11*a*, a semi-elliptic part 11*b*, and a second rectangular part 11*c* (see FIG. 5).

The first rectangular part 11*a* is made of a rectangular copper foil having a width W (W=36 mm in the present embodiment) and a height H' (H'=9 mm in the present embodiment). The semi-elliptic part 11*b* is made of a semi-elliptic copper foil obtained by bisecting, by a major axis, an ellipse which has a minor axis radius a (a=13.5 mm in the present embodiment) and a major axis radius b (b=W/2=18 mm in the present embodiment). The major axis is connected to an end side of the first rectangular part 11*a* which end side has the width W. The second rectangular part 11*c*, which is connected to a first side of the semi-elliptic part 11*b* which first side is opposite from a second side of the semi-elliptic part 11*b* to which second side the first rectangular part 11*a* is connected, is directed to carry out impedance matching of the antenna element 11 and the feed line 12. According to the present embodiment, the second rectangular part 11*c* is made of a rectangular copper foil having a width W' (W'=12 mm in the present embodiment) and a height H" (H"=1 mm in the present embodiment). The entire antenna element 11 has a height H of 23.5 mm.

Use of the antenna element 11 having the configuration allows the UWB to be the operation band. Note, however, that a shape of the antenna element 11 is not limited to this. A planar conductor having any shape is usable as the antenna element 11 provided that the planar conductor allows the UWB to be the operation band.

[Filter Characteristics and Antenna Characteristics]

Next, filter characteristics and antenna characteristics of the antenna 1 are described below with reference to FIGS. 6 to 8.

FIG. 6 is a graph showing VSWR characteristics of the antenna 1 which are obtained when the antenna element 11 is removed. The VSWR characteristics of the antenna 1 which VSWR characteristics can be obtained when the antenna element 11 is removed refer to filter characteristics of the microstrip line constituted by the feed line 12 and the ground plate 13. The graph of FIG. 6 shows that a VSWR value leaps in each of the 2.5 GHz band and the 5 GHz band, i.e., that reflection occurs in each of the 2.5 GHz band and 5 GHz band.

Note that FIG. 6 shows together a result of calculation (numerical simulation) and a result of actual measurement. These results favorably match each other. FIG. 6 also confirms propriety of a design method using the telegraphic equations.

(a) of FIG. 7 is a graph showing VSWR characteristics of the antenna 1 which are obtained when the antenna element 11 is provided to the antenna 1. The graph of (a) of FIG. 7 shows that a VSWR value is controlled to 2 or less in a band obtained by excluding the 2.5 GHz band and the 5 GHz band from the UWB, i.e., that the antenna 1 operates in the band obtained by excluding the 2.5 GHz band and the 5 GHz band from the UWB.

(b) of FIG. 7 is a graph showing VSWR characteristics of the antenna 1 which are obtained when the width of the feed line 12 is made uniform. The graph of (b) of FIG. 7 shows that a VSWR value decreases to 2 or less in each of the 2.5 GHz band and the 5 GHz band when the width of the feed line 12 is made uniform, i.e., that the antenna 1 operates in each of the 2.5 GHz band and the 5 GHz band. This confirms that the operation of the antenna 1 is inhibited in each of the 2.5 GHz band and the 5 GHz band because the width of the feed line 12 is nonuniform.

Note that FIG. 7 also shows together a result of calculation (numerical simulation) and a result of actual measurement. These results favorably match each other. FIG. 7 also confirms propriety of a design method using the telegraphic equations.

FIG. 8 are graphs each showing a radiation pattern of the antenna 1. (a) of FIG. 8 shows a radiation pattern obtained at 2.5 GHz, (b) of FIG. 8 shows a radiation pattern obtained at 4.0 GHz, (c) of FIG. 8 shows a radiation pattern obtained at 5.5 GHz, and (d) of FIG. 8 shows a radiation pattern obtained at 7.0 GHz. In each of the graphs, a comparison of a case (w/o filter) where the width of the feed line 12 is made uniform and a case (w filter) where the width of the feed line 12 is made nonuniform shows a significant decrease in gain in each of the 2.5 GHz band (2.5 GHz) and the 5 GHz band (5.5 GHz). That is, in a case where the width of the feed line 12 is made nonuniform, it is possible to confirm that the operation of the antenna 1 is inhibited in each of the 2.5 GHz band and the 5 GHz band.

[Modification]

According to the present embodiment, the feed line 12 is configured such that the spiral part 12*b* of the feed line 12 is wound so that a radius of curvature smoothly decreases as the spiral part 12*b* approaches an end point thereof on a side opposite from the feed point P. However, a configuration of the feed line 12 is not limited to this. For example, the feed line 12 can also be configured to have a spiral shape in which linear parts 12*c* and quadrantal parts 12*d* alternate with each other as illustrated in FIG. 9. This makes it possible to more efficiently provide the feed line 12 on the dielectric substrate 10 having a square or rectangular main surface. Note that the quadrantal parts 12*d* are provided so as to prevent reflection from occurring at a point where a curvature of the feed line 12 discontinuously changes.

Furthermore, according to the present embodiment, the feed line 12 is provided on the bottom surface of the dielectric substrate 10. However, where to provide the feed line 12 is not limited to this. That is, the feed line 12 can also be provided on the top surface of the dielectric substrate 10 as illustrated in FIG. 9. In this case, it is only necessary that the ground plate 13 be provided on the bottom surface of the dielectric substrate 10. Further, in this case, it is only necessary that the antenna element 11 and the feed line 12 be provided on the top surface of the dielectric substrate 10 so as to be directly connected with each other.

[Summary]

As described above, an antenna in accordance with the present embodiment includes: a dielectric substrate; a ground plate provided on a first main surface of the dielectric substrate; a feed line provided on a second main surface of the dielectric substrate; and an antenna element connected to the feed line and provided (standing) on the first main surface or the second main surface of the dielectric substrate, the feed line being a belt-shaped conductor which has a nonuniform width, and together with the ground plate which faces the feed line via the dielectric substrate, the feed line constituting a microstrip line which functions as a BRF (band reject filter).

According to the configuration, since the feed line and the ground plate constitute a microstrip line which functions as the BRF, it is possible to provide an antenna which, while being operable in a wide operation band, avoids interfering with a part of the wide operation band. In this case, the microstrip line is constituted by the feed line and the ground plate. This requires no mounting area for providing a BRF separately from the microstrip line. Therefore, the antenna requires a smaller mounting area than a conventional antenna.

The antenna in accordance with the present embodiment is preferably configured such that the antenna element is provided (stands) on the first main surface of the dielectric substrate and is connected to the feed line via a conductor wire which extends through a through hole provided in the dielectric substrate.

According to the configuration, the ground plate is provided between the antenna element and the feed line. Therefore, it is possible to prevent a stopband of the microstrip line from changing by an influence of an electromagnetic field formed near the antenna element.

The antenna in accordance with the present embodiment is preferably configured such that the antenna element is provided (stands) on the second main surface of the dielectric substrate and is directly connected to the feed line.

According to the configuration, it is unnecessary to provide a through hole in the dielectric substrate and connect the antenna element and the feed line via the conductor wire which extends through the through hole. This facilitates production of the antenna and allows a reduction in production cost.

The antenna in accordance with the present embodiment is preferably configured such that the feed line has a spiral part which is wound in a spiral form.

According to the configuration, it is possible to provide a longer feed line in a narrower region. Therefore, it is possible to make the dielectric substrate smaller without sacrificing a band rejection function of the microstrip line. This allows the antenna to be still smaller.

The antenna in accordance with the present embodiment is preferably configured such that the spiral part is wound in the spiral form in which a radius of curvature of the spiral part smoothly decreases as the spiral part approaches an end point thereof.

According to the configuration, since the spiral part has no corner, it is possible to prevent unnecessary reflection which may occur at a corner. Therefore, it is possible to prevent the stopband of the microstrip line from changing by the unnecessary reflection.

The antenna in accordance with the present embodiment is preferably configured such that the spiral part is wound in the spiral form in which straight lines and quadrants alternate with each other.

The configuration allows an outline of the spiral part to be substantially rectangular or square without forming an angle. This makes it possible to efficiently provide the feed line on the dielectric substrate having a rectangular or square shape.

The antenna in accordance with the present embodiment is preferably configured such that the antenna element is a bell-shaped planar conductor having a rectangular part and a semi-elliptic part.

According to the configuration, it is possible to provide a wide band antenna such as a UWB wireless antenna.

The antenna in accordance with the present embodiment may be configured such that the BRF has a single stopband or two or more discontinuous stopbands.

[Additional Remarks]

The present invention is not limited to the foregoing embodiments, but rather can be applied in many variations within the scope of the claims. That is, a new embodiment obtained from a proper combination of technical means within the scope of the claims is also included in technical scope of the present invention.

INDUSTRIAL APPLICABILITY

The present invention is suitably usable as a wide band antenna which avoids interfering with a specific band, e.g., a UWB wireless antenna which avoids interfering with a 2.5 GHz band and a 5 GHz band.

REFERENCE SIGNS LIST

1 Antenna
10 Dielectric substrate
10*a* Through hole
11 Antenna element
12 Feed line
13 Ground plate
13*a* Opening
13*b* Opening
14 Conductor wire
15 Dielectric substrate
P, Q Feed point

The invention claimed is:

1. An antenna comprising:

a dielectric substrate;

a ground plate provided on a first main surface of the dielectric substrate;

a feed line provided on a second main surface of the dielectric substrate; and an antenna element connected to the feed line and standing upright on the first main surface of the dielectric substrate, the feed line having a nonuniform width, and together with the ground plate which faces the feed line via the dielectric substrate, the feed line constituting a microstrip line which functions as a BRF (band reject filter), and the ground plate being provided with an opening via which the antenna element is connected to a region in which the dielectric substrate is exposed; and wherein the opening is entirely surrounded by the ground plate.

2. The antenna as set forth in claim 1, wherein the antenna element is connected to the feed line via a conductor wire which extends through a through hole provided in the dielectric substrate.

3. The antenna as set forth in claim 1, wherein the feed line has a spiral part which is wound in a spiral form.

4. The antenna as set forth in claim 3, wherein the spiral part is wound in the spiral form in which a radius of curvature of the spiral part continuously decreases as the spiral part approaches an end point thereof.

5. The antenna as set form in claim 3, wherein the spiral part is wound in the spiral form in which straight lines and quadrants alternate with each other.

6. The antenna as set forth in claim 1, wherein the antenna element is a bell-shaped planar conductor having a rectangular part and a semi-elliptic part.

7. The antenna as set forth in claim 1, wherein the BRF has two or more discontinuous stopbands.

8. The antenna as set forth in claim 2, wherein the feed line has a spiral part which is wound in a spiral form.

9. The antenna as set forth in claim 1, wherein the antenna element is provided on the first main surface of the dielectric substrate, and the antenna element stands such that a part of the ground plate is positioned just beneath the antenna element.

10. The antenna as set forth in claim 9, wherein the antenna element stands such that the part of the ground plate is positioned between the antenna element and the dielectric substrate.

* * * * *